US008365503B2

(12) United States Patent
Mellentin

(10) Patent No.: US 8,365,503 B2
(45) Date of Patent: Feb. 5, 2013

(54) METHOD AND A DEVICE FOR PLACING OF A CARD OR THE LIKE IN A SHEET

(76) Inventor: Jens August Mellentin, Kirke Hyllinge (DK)

( * ) Notice: Subject to any disclaimer, the term of this patent is extended or adjusted under 35 U.S.C. 154(b) by 456 days.

(21) Appl. No.: 12/742,519

(22) PCT Filed: Nov. 28, 2008

(86) PCT No.: PCT/DK2008/000423

§ 371 (c)(1),
(2), (4) Date: May 12, 2010

(87) PCT Pub. No.: WO2009/068037

PCT Pub. Date: Jun. 4, 2009

(65) Prior Publication Data

US 2010/0255974 A1 Oct. 7, 2010

(30) Foreign Application Priority Data

Nov. 29, 2007 (ES) ..... 200703170

(51) Int. Cl.
*B65B 47/00* (2006.01)

(52) U.S. Cl. ..... 53/445; 443/158; 443/255; 443/284.2

(58) Field of Classification Search ..... 53/443, 53/445, 158, 255, 284.2
See application file for complete search history.

(56) References Cited

U.S. PATENT DOCUMENTS

| | | | | |
|---|---|---|---|---|
| 3,274,665 | A * | 9/1966 | Higginson et al. | 29/33 R |
| 3,484,097 | A * | 12/1969 | Jory | 270/52.13 |
| 3,704,015 | A * | 11/1972 | Holovka et al. | 270/52.13 |
| 4,384,196 | A * | 5/1983 | McCumber et al. | 235/375 |
| 4,893,535 | A | 1/1990 | Bentrim et al. | |
| 5,058,873 | A * | 10/1991 | Hewitt et al. | 270/52.13 |
| 5,388,815 | A * | 2/1995 | Hill et al. | 270/32 |
| 7,673,865 | B2 * | 3/2010 | Greene et al. | 270/52.02 |

FOREIGN PATENT DOCUMENTS

| | | |
|---|---|---|
| DE | 19840838 A1 | 3/2000 |
| WO | 91/13019 A | 9/1991 |

* cited by examiner

*Primary Examiner* — Christopher Harmon
(74) *Attorney, Agent, or Firm* — David A. Guerra

(57) ABSTRACT

A device far placement of a card in a sheet, the device having one support plaque of the sheet, with windows for insertion of the corners of the card, cutting blades facing the windows to be displaced through the windows to provide oblique cuts on the sheet. The device further has a card holder plaque for fastening the card in a window, wherein part of the contour of this window is level with the route of the blades. Pushers are moveable towards the support plaque, facing the windows of the support plaque, for insertion of the corners of the card through the oblique cuts of the sheet. The cutting blades and of the pushers are displaced by an actuator.

20 Claims, 8 Drawing Sheets

METHOD AND A DEVICE FOR PLACING OF A CARD OR THE LIKE IN A SHEET

CROSS-REFERENCE TO RELATED APPLICATIONS

This application is an U.S. national phase application under 35 U.S.C. §371 based upon co-pending International Application No. PCT/DK2008/000423 filed on Nov. 28, 2008. Additionally, this U.S. national phase application claims the benefit of priority of co-pending International Application No. PCT/DK2008/000423 filed on Nov. 28, 2008, and Spain Application No. P200703170 filed on Nov. 29, 2007. The entire disclosures of the prior applications are incorporated herein by reference. The international application was published on Jun. 4, 2009 under Publication No. 2009/068037.

OBJECT OF THE INVENTION

The invention relates to a method and a device for placing cards made of cardboard, plastic or other flexible materials, in sheets, such as folders, file covers or letters of introduction. Alternatively, the device can be used in connection with photos, digital units, scrap book material, etc.

BACKGROUND OF THE INVENTION

It is common in the business world of today to annex a flexible card to a document or sheet, wherein said card may be, for example, a business card, a credit card or a hotel key.

In the case of business cards, stapling the card over the sheet has fallen into disuse, since it makes it difficult for the receiver to retrieve the card intact and keep it separate from the sheet. Another method to annex cards, such as credit cards, to sheets, is to use adhesive tape, which gives a poor and careless image. Some companies dedicated to the production of corporate and presentation sheets have designed sheets and covers with oblique cuts or diagonal slots, to insert the corners of a flexible card, whereby said card is secured to the sheet.

These oblique cuts allow the card to be retrieved easily and the document to present an impeccable appearance; however, these cuts or slots are generally made at a work-shop by using a die-cutting machine and the insertion of the cards must be done manually, by arching the cards to insert their corners in the oblique cuts. This work is done in a totally manual fashion and without using any kind of tool, and is therefore a tedious task.

U.S. Pat. No. 4,941,381 of Sandra Brown Garner and U.S. Pat. No. 4,879,932 of William J. Scalise describe manual machines to create cuts for the insertion of cards. These machines are based on paper punching machines used to make bookbinding orifices on paper sheets, but can only be used to make a few cuts, and the insertion of the card corners in the cuts made must be done manually, which is a slow and laborious process.

The object of the invention is therefore to provide a device that performs both the oblique cuts on any sheet or laminar surface, as well as the automatic insertion of the card, which functions in a convenient and reliable manner and is especially suitable for personal or office use.

DESCRIPTION OF THE INVENTION

This device for the insertion of cards in sheets and similar features some technical particularities meant to perform, preferably in a single operation, the cutting of the sheet and the insertion of a flexible card, with a suitable finishing and in a simple action.

According to the invention, the device comprises at least the following components:

- a support means for support of the sheet, said support means having windows,
- cutting means, which are able to operate on the sheet to provide one or several cuts in the sheet,
- a cardholder for holding a card, placed close to the support means, said card holder having a window of approximately the same dimensions as the card, at least a part of the contour of the perimeter of said window being in line with the route of the cutting means for providing cuts in the sheet,
- displacement means, moveable towards the support means and the card-holder, facing the windows of the support means and the window of the card holder between a non-operative position in distance from the support means and the cardholder, and an operative position, in which they pass through the window of the cardholder and the cut or cuts in the sheet, lodging themselves in the windows of the support means, deforming the ends of some of the corners of the card and inserting said ends or said corners of the card through the cuts in the sheet and
- an actuator for actuating the cutting means and the displacement means.

In one embodiment of the invention, the cutting means are arranged below the support means under the support surface of the sheet, so that in a first movement the cut of the sheet is made from below upwards. It is also within the framework of the invention that the cutting means are arranged over the cardholder plaque, so as to perforate the sheet during the descent of said cardholder or of the pushers.

The oblique cut made by the cutting means can have any adequate shape to allow the insertion of the corner of the card by the action of the pusher. In one preferred embodiment, this oblique cut has the shape of a flap with a flexible flange, which opens a sufficiently wide strip of the paper of the sheet.

The cutting means in the form of blades are forced by means of a return spring, which allows for a planned advance during the cutting of the sheet or its removal once the oblique cuts are made.

It is also within the framework of the invention that the blades are inverted, so that they cut the sheet from above downwards, whereby the blades are arranged independently or in conjunction with the cardholder plaque itself.

The activating actuator comprises preferably a platform and a moveable push lever, wherein both are mutually articulated on an axis. This actuator can also be activated automatically or by means of a motor.

It is also within the framework of the invention that to hold the card and the sheet during the manipulations of the device, the cardholder comprise an associated peg, which extends over the window of said cardholder and against the support means, permitting a temporary immobilisation of said card and of the sheet during the cutting and insertion process.

The cutting blades present principally a straight cut, prolonged by two angle-cut edges for the configuration of the oblique cut of the sheet in the form of a collapsible flap, which is advantageous for the insertion of the corner of the card in the sheet.

The device can feature two blades only, as will be depicted later, configuring the oblique cuts in an opposed diagonal arrangement, or, in an alternative embodiment, it can feature four blades operated in pairs to make four oblique cuts corresponding to the four corners of a card.

The cutting blades can also have a configuration, in which each blade has two longitudinal lateral slots, in which sliding, moveable hooks are placed by adequate means. When a card is inserted into a sheet, said cutting blade makes an oblique cut and, by adequate means, the hooks emerge from the blade, still in an elevated position, through the oblique cut in the sheet. In this position the hooks go over the position of the card and hold it down by both convergent laterals of the corner. When descending the blade once the cut is made, the hooks will also descend, pulling the corner of the card and inserting it into the oblique cut made. These hooks can replace the pushers or reinforce their function, depending on the characteristics of the type of cards to be placed.

Despite being flexible, plastic cards such as credit cards and hotel card keys are significantly more rigid than conventional business cards. They are hard to handle in an automatic way. Therefore, it is within the framework of the invention that the device comprises an archer of said card over the cardholder plaque before inserting in into the sheet, which permits the insertion of the corners of said card laterally into the oblique cuts, instead of inserting it vertically.

To achieve this, the archer comprises a plaque with two sets of lateral buffers or holders, arranged at a shorter distance than the two opposed laterals of the window of the cardholder. In this way, the placement of a card on said archer is accomplished by holding the card in an arched form. When activating the device the archer is placed manually or automatically against the window of the cardholder, for example in an oscillating way, and the actuator presses said card by means of pusher elements from its posterior side, for example through a window in the card holder, forcing the card to spring out from the lateral buffers, allowing its lateral entry into the oblique cuts of the sheet, done previously by the blades during the activation of the device.

In case the card is inserted into the sheet by two corners only, said archer features an oblique placement of the card, in accordance with the window of the cardholder, thus achieving a better transversal tension in the arching of the card along its diagonal.

It is also within the framework of the invention that the device is equipped with an automatic or semiautomatic loading system for the cards to be placed. To this end, the window of the cardholder plaque features lateral holders for a card to be placed in a level position in relation to its surface, wherein the card is supplied from a loading box above. These lateral holders can consist of pivots or a step arranged along the perimeter of the inner contour of the window. The cardholder, on the other hand, features guides around or close to the window for the coupling of a superior card loading box. This box can be moved from a non-operative to an operative position, wherein it faces the aforementioned window, by rotation or linear movement, so that the lower card enters the interior of the window and is supported on the holders; the rest of the cards remain in the interior of the box for future use.

DESCRIPTION OF THE FIGURES

To complement the description being conducted and with the object of facilitating the comprehension of the characteristics of the invention, this description is accompanied by a set of drawings in which.

PREFERRED EMBODIMENT OF THE INVENTION

Figure 1:
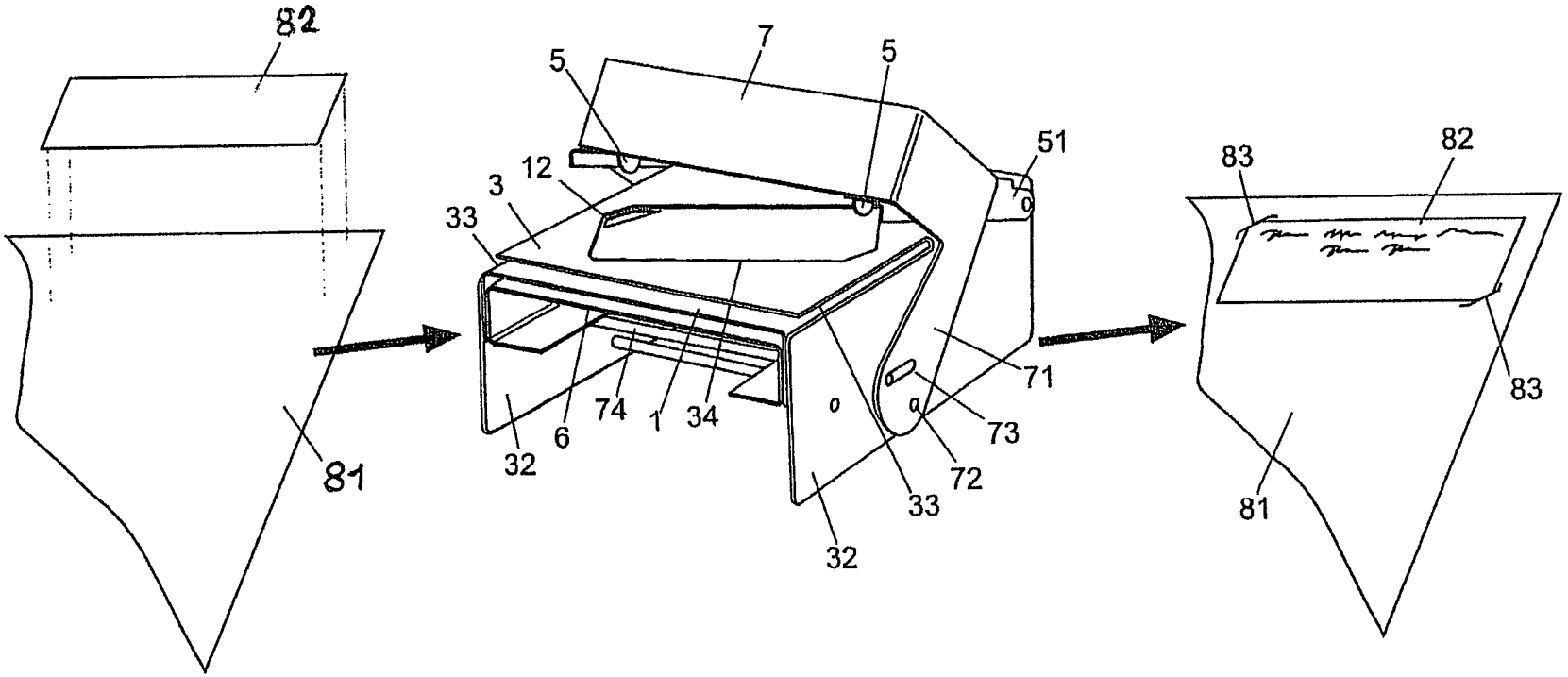
FIG. 1 illustrates a perspective view of the device according to the invention and the placing of a card on a sheet.

As can be seen in the Figures, especially FIG. 1, the device according to the invention for placement of cards in sheets or similar comprises a support means 1 in the form of a plaque for support of a sheet 2, a cardholder in the form of a plaque 3 arranged over the support plaque 1, internal cutting blades 4 and external pushers 5, all connected to a movement actuator of the cutting blades 4 and of the pushers 5 over the support plaque 1 and the cardholder plaque 3.

The support plaque 1 has preferably a rectangular shape with two opposing folded lateral flaps, with two windows 12 in the upper face for the passage of the cutting blades 4. Between the flaps of the support plaque 1 is a lodging plaque 6 for the cutting blades 4, said plaque having its two lateral extremities folded in a "C" shape, wherein is a respective blade 4 forced by a spring 41 and arranged as sliding between two opposing orifices 61 in the plaque 6.

The actuator is constituted by a support platform and a tilting pusher 7. The support platform has a general "U" shape with two lateral flaps 32 and an upper part, which extends from the cardholder plaque 3, defining longitudinal slots 33 of separation of said cardholder plaque 3 in respect to the lateral flaps 32, over which the support plaque 1 is fixated in a parallel and slightly proximate way. The hollow space defined between the cardholder plaque 3, the support plaque 1 and the lateral slots 33 allows an insertion of the sheet 1 over which a card 82 will be placed, which is facing the windows 12 of the support plaque 1, and in this case arranged diagonally, for the frontal placement of the corner of the sheet 81 and of the card 82.

The pusher 7 is constituted by means of a handle or transversal bar with two lateral arms 71, descending to both sides of the platform, over which they are articulated by a rotation axis 72. Each arm 71 has a mounting hole 73 for displacement of one extreme of an internal transversal bar 74 to push the cutting blades 4, wherein in each lateral flap 32 is a triangular window 35 to limit the displacement of said transversal bar 74 in contact with the lower extremity of the cutting blades 4 arranged as projecting from the orifices 61.

Figure 2:
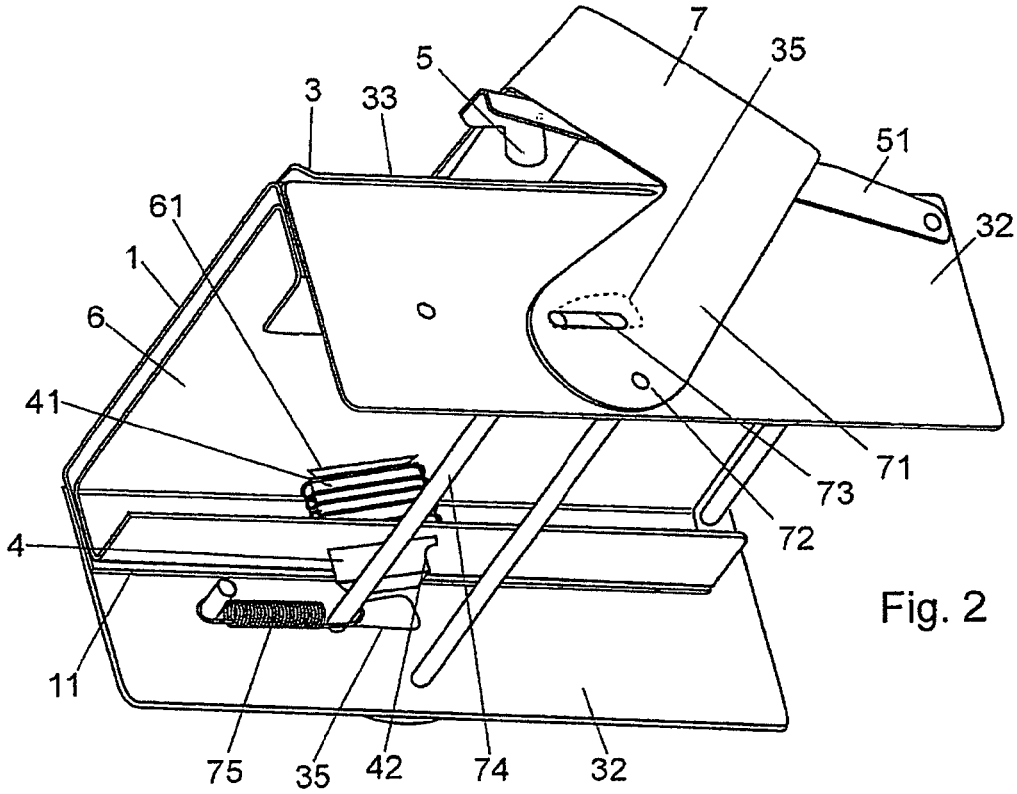
FIG. 2 depicts an inferior perspective view of the device in a position wherein cutting blades are retracted and pushers are distanced from a window of a cardholder plaque.
Figure 3:
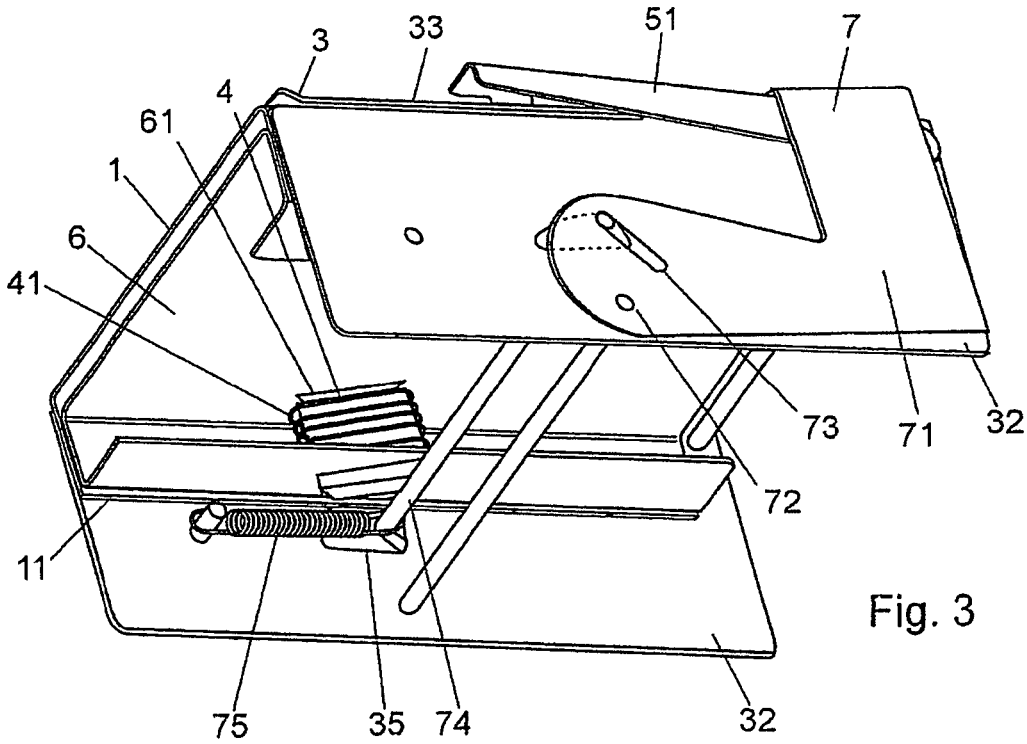
FIG. 3 depicts an inferior perspective view of the device wherein the cutting blades are upright in the process of making oblique cuts and the pushers are close to the window of the cardholder plaque.
Figure 4:
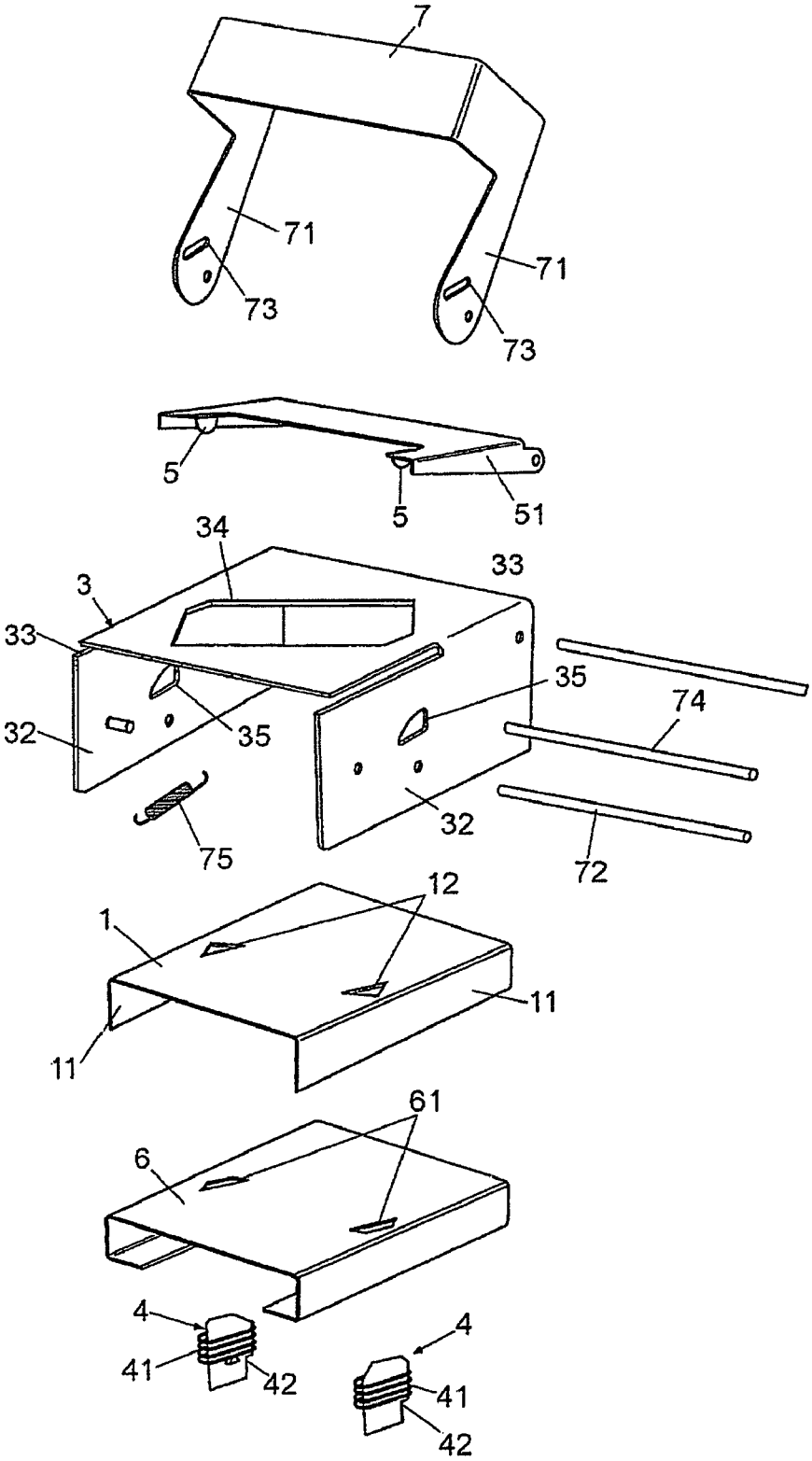
FIG. 4 depicts an exploded view of the device
Figure 5:
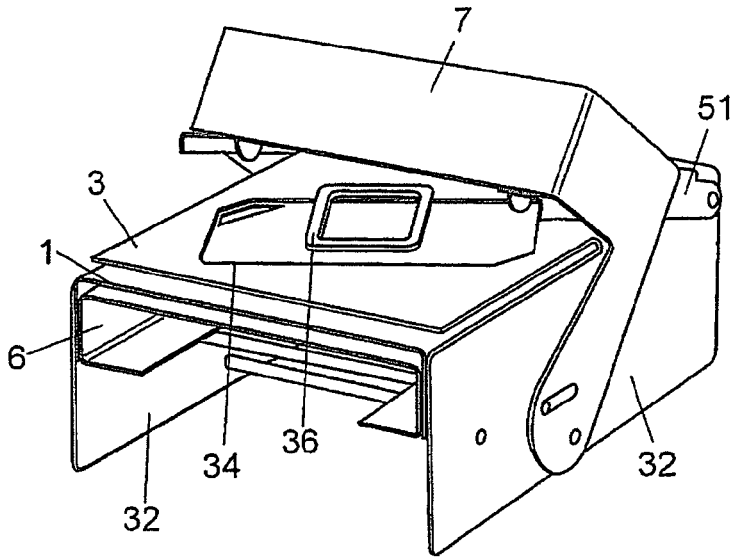
FIG. 5 depicts a perspective view of the device, showing a holding peg.

As it appears from FIGS. 2 and 3, the device has at least one tension spring 75 for the transversal bar 74 anchored to the inner side of the lateral flaps 32 of the platform. Each cutting blade 4, in turn, presents a lower extremity, in contact with the transversal bar 74, significantly flat up to a step 42 pronounced in its side opposed to the spring 75 to produce the sudden descent of said blade 4 as the transversal bar 74 is moved by the action of the mounting hole 73 of the push lever 7.

At the extremity of the cardholder plaque 3 are articulated two oscillating levers 51, which in their free extremity present lower appendixes that configure the pushers 5, so that the movement of the push lever 6 of the actuator makes them descend towards the window 34 of the cardholder plaque 3 and the windows 12 of the support plaque 1. This descent allows said pushers 5 to insert the corners of the card 82 into the oblique cuts 83 provided by means of the blades 4.

In an alternative embodiment, the cardholder plaque 3 has a peg 36 extended over the window 34 with elastic arms to hold down the card 82 and the sheet 81 during the cut and insertion operation.

Figure 6:
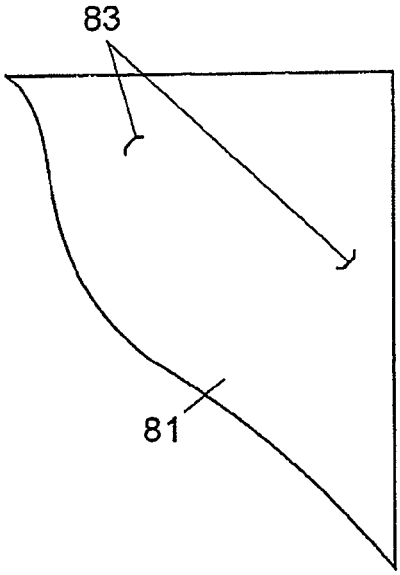
FIG. 6 depicts a detail of a sheet perforated with two diagonally arranged oblique cuts.
Figure 7:
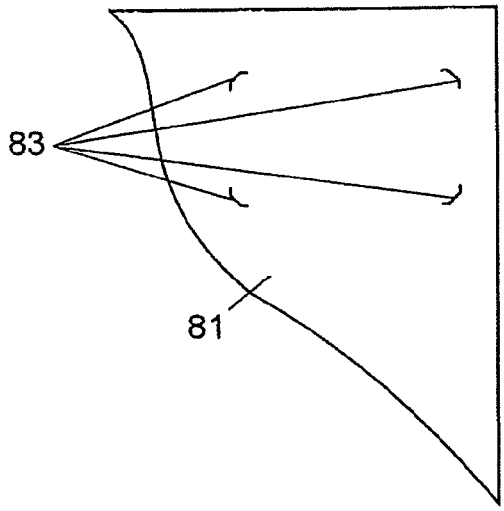
FIG. 7 depicts a detail of a sheet perforated with four oblique cuts.

FIGS. 6 and 7 show the oblique cuts 83 in a sheet 81 by means of a configuration of the device with two blades 4 arranged diagonally or with a configuration of the device with four cutting blades 4 corresponding to the corners of the card 82. Both figures illustrate how each cutting blade produces an oblique cut 83 with a straight section flanked by two angled sections, configuring a collapsible inner flap.

Figure 8:
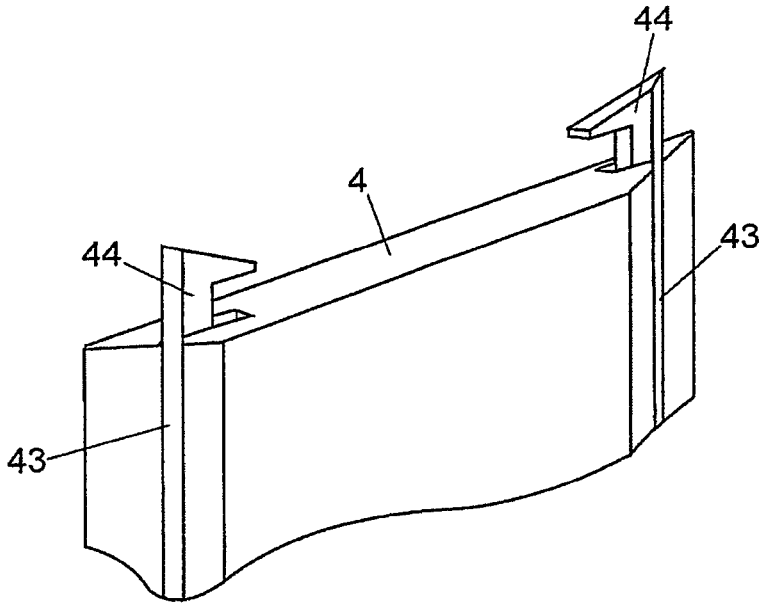
FIG. 8 depicts a perspective view of a detail of blades with card traction hooks.

In an advanced embodiment of the device, illustrated in FIG. 8, each cutting blade 4 has two longitudinal lateral slots 43 arranged in opposition and emerging from the upper extremity. In each lateral slot 43, there is a sliding hook 33 movable by adequate means, permitting its emerging exit by the upper part of the cutting edge of the blade 4, which is operationally adapted for holding the corner of the card 82 when the blade 4 retracts.

Figure 9:
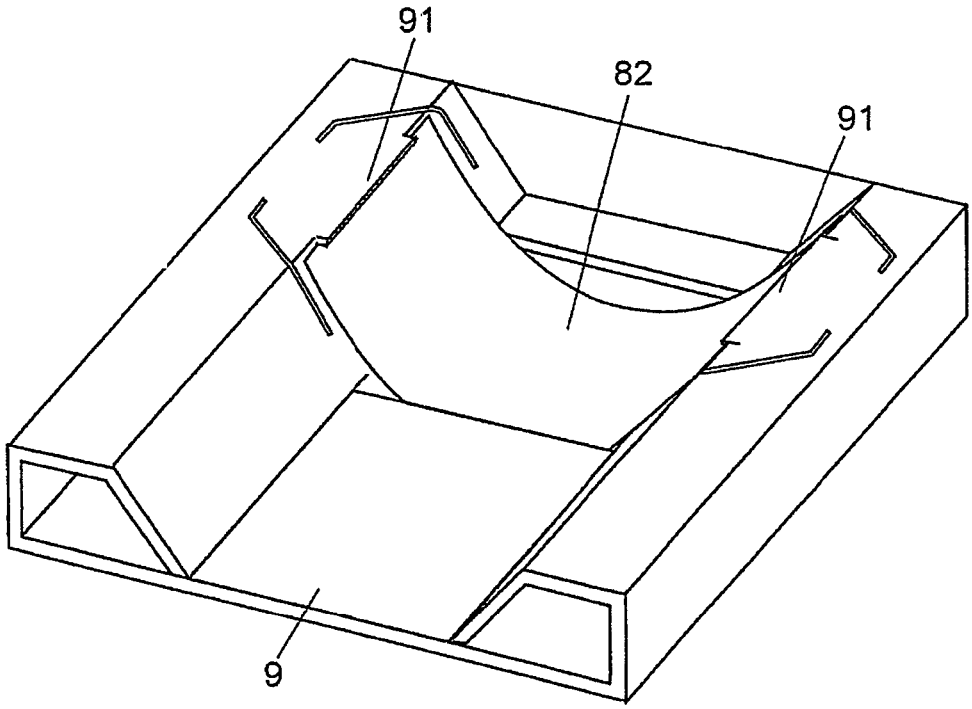
FIG. 9 depicts a perspective view of a card archer.
Figure 10:
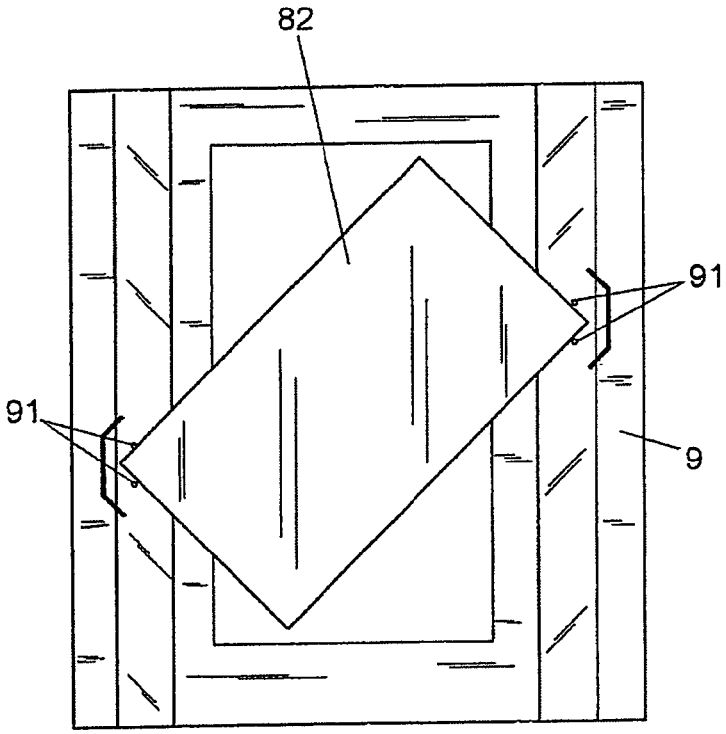
FIG. 10 depicts a plane view of an alternative embodiment of the archer with a card arranged obliquely for insertion in two diagonal oblique cuts.

The device may comprise an archer for the insertion of plastic or significantly rigid cards 82, illustrated in FIGS. 9 and 10. This archer is constituted by an oscillating plaque 9 arranged between the push lever 7 of the actuator and the cardholder plaque 3. This plaque 9 is provided with two sets of lateral buffers 91 or holders arranged at a distance which is inferior to the distance between the opposed laterals parallel to the window 34. The card 82 placed in said plaque 9 of the archer is folded due to the fact that the lateral buffers 91 are at an inferior distance than its longitude. The push lever 7 of the actuator is in its interior part provided with elements (not illustrated) that push the card 82 through a posterior window of the plaque 9 for its extraction from the archer and insertion into the sheet 81.

Figure 11:
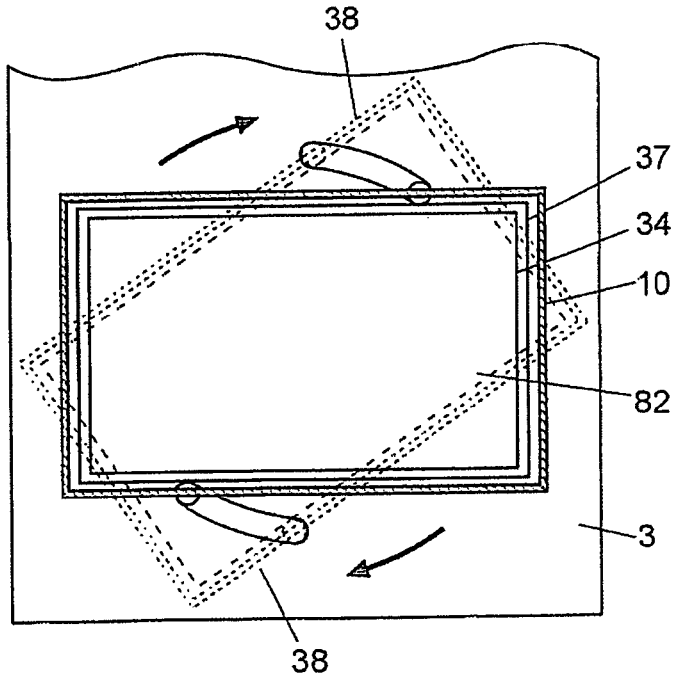
FIG. 11 depicts a plane view of a detail of the cardholder plaque for coupling of the card loader with the device.
Figure 12:
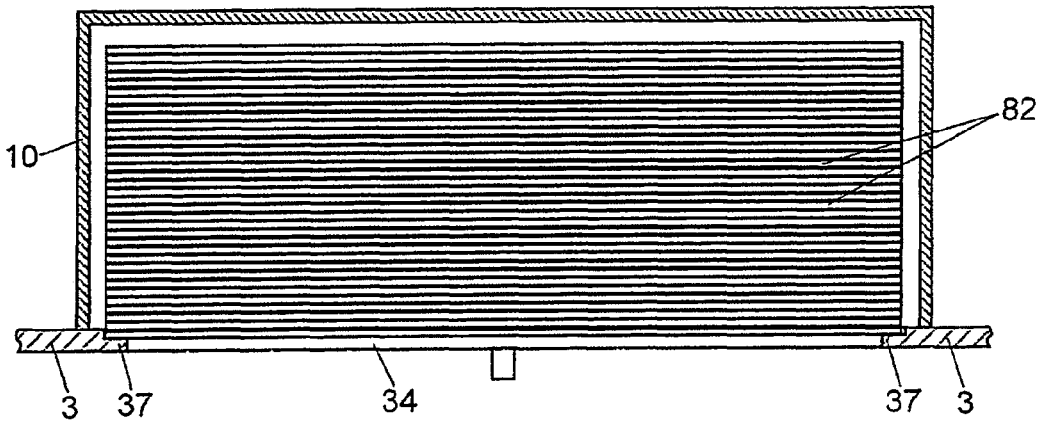
FIG. 12 depicts an elevated section view of the box of the loader over the cardholder plaque for supplying of cards.

In a semiautomatic embodiment of the device, illustrated in FIGS. 11 and 12, it comprises in the window 34 of the cardholder plaque 3 lateral holders 37 of a card 82 in a level position with its surface, as its height is equivalent to the thickness of the card 82. The cardholder plaque 3 features guides 38 around the window 34 for the coupling of a superior loading box 10 and its displacement in front of the window 34 for the individual supplying of cards 82, be it by the action of gravity or pushed by a spring (not depicted).

Figure 13:
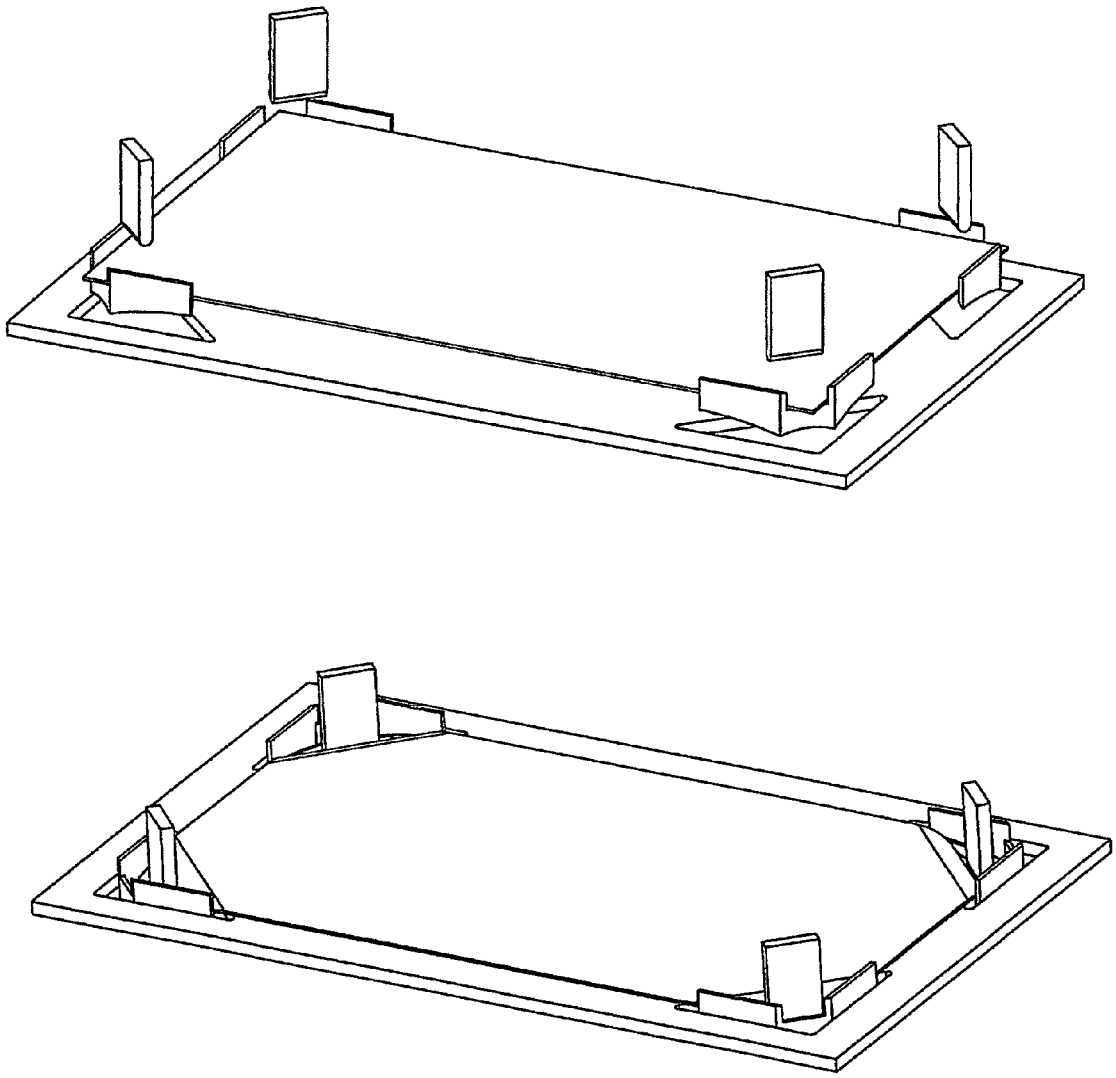
FIG. 13 illustrates an embodiment, in which the cutting in the sheet and the pushing of the corners of the card into the sheet is performed from the same side.

FIG. 13 illustrates an embodiment, in which the cutting in the sheet and the pushing of the corners of the card into the sheet is performed from the same side. The Figure illustrates only the card holder plaque for holding the card, said card holder being configurated by the four knives together, and the support plaque underneath, not the sheet.

In a special embodiment, the card holder and the four knives are formed in one piece. When the card holder with the knives has been pressed through the sheet, the corners of the card by means of the pushers are pressed through the openings in the card holder and past the knives and into the cuts in the sheet.

First, the cutting blades for cutting in the sheet are displaced through the windows of the support holder plaque effectuating the cuts against a stop by means of a spring having a relatively small strength. Secondly, pushers, which are loaded by means of spring, are displaced through the same windows in the card holder plaque for placing the card in the cuts in the sheet.

If the card holder is not constituted by the knives, the four knives may be situated beneath the card holder. As a result, the card will be pressed down beneath the knives and, not until now, is a physical card holder corresponding to the card holder provided by using the four knives as a card holder, provided.

Now that the gist of the invention has been sufficiently described, as well as an example of a preferred embodiment, let it be known to whom it may concern, that the materials, shape, size and arrangement of the elements described can be modified, as long as this does not alter the essential characteristics of the invention that are claimed.

Alternative cutting means are lasers, digital knives, etc.

Further, the method according to the invention can be used in connection with photos, digital units, scrap books, etc.

The cutting means consisting of only one cutting blade alternatively can be used to provide an adjustable corner, etc.

The sheets naturally can be delivered by means of a sheet feeder as well as the cards or the like, which may be delivered by means of a card feeder. A number of cards may f. inst. be placed in the device itself.

The means for supporting the sheet are not necessarily plane; they may f. inst. also be curved.

The card holder is not necessarily plane. It may f. inst. also be curved.

The device may be built into a printer, which is able to print and cut out visit cards or figures. The device may be adapted to place the card/figure on a sheet, which may have been provided with text or prints from the same printer. The visit card may also be stored digitally in the printer for printing out of the visit cards to be placed on the sheet.

The invention claimed is:

1. A device for placement of a card in a sheet comprising:

a support for supporting a sheet, said support having at least one defined opening, and a cutting device adapted to operate on said sheet to provide at least one cut in said sheet;

a card holder for holding a card placed close to said support, said card holder having an opening of approximately the same dimensions as said card, at least a part of a contour of a perimeter of said opening being in line with a route of said cutting device for providing at least one cut in said sheet;

at least one displacement device movable towards said support and said card holder, said displacement device facing said opening of said support and said opening of said card holder between a non-operative position in distance from said support and said card holder, and an operative position in which said displacement device passes through said opening of said card holder and said cut in said sheet, said displacement device being configured to be lodged in said opening of said support, deforming at least one edge of said card and inserting said edge of said card through said cut in said sheet; and an actuator for actuating said cutting device and said displacement device.

2. The device according to claim 1, wherein the cutting device comprising cutting blades to be displaced between a non-operative position with said cutting blades being arranged at a distance from said support, and an operative position with said cutting blades being inserted in said opening of said support.

3. The device according to claim 2, wherein said cutting blades are hyperbolic cutting blades and are movable in a downward direction.

4. The device according to claim 1, wherein said cut is selected from the group consisting of an oblique cut, a rounded cut, and a hyperbola.

5. The device according to claim 2, wherein said cutting blades are arranged below said support under a support surface of said sheet.

6. The device according to claim 2, wherein said cutting blades are forced by springs.

7. The device according to claim 1, wherein said actuator comprising a platform and a push lever.

8. The device according to claim 1, wherein said card holder comprising a peg extended over said window of said card holder in order to temporarily hold said card and said sheet over said support.

9. The device according to claim 2, wherein each of said cutting blades comprising a straight cut edge prolonged by two angle-cut edges for providing an oblique cut in said sheet in the form of a collapsible flap.

10. The device according to claim 9, wherein each of said cutting blades comprising two longitudinal lateral slots inside each of which there is a sliding hook that is displaceable by appropriate means for fastening of said corner of said card, once said oblique cut is provided, in order to pass said corner of said card through said oblique cut.

11. The device according to claim 1 further comprising an archer for said card arranged over said card holder, said archer having two lateral buffers arranged at a mutual distance being shorter than a distance between opposed parallel laterals of said window of said card holder, wherein said actuator having pushing elements for insertion of said card.

12. The device according to claim 1, wherein said window of said card holder further comprising lateral holders for said card in a position which is at level with an upper surface, supplied by a superior loading box.

13. The device according to claim 10, wherein said card holder has guides around or proximate to said window for said card holder for coupling of a superior loading box and displacement of said loading box to face said window of said card holder and supplying of said card to be introduced.

14. The device according to claim 1, wherein said device being integral with a printer.

15. A card placement device:

a support plaque for supporting a sheet, said support plaque having at least one opening, and cutting blades being operated by springs on said sheet to provide at least one cut in said sheet, said cutting blades being displaced between a non-operative position with said cutting blades being arranged at a distance from said support plaque, and an operative position with said cutting blades being inserted in said opening of said support plaque respectively, said cutting blades being arranged below said support plaque under a support surface of said sheet;

a cardholding plaque for holding a card placed close to said support plaque, said cardholding plaque having an opening of approximately the same dimensions as said card, at least a part of a contour of a perimeter of said opening being in line with a route of said cutting blades for providing at least one cut in said sheet;

a pusher movable towards said support plaque and said cardholding plaque, said pusher facing said opening of said support plaque and said opening of said cardholding plaque between a non-operative position in distance from said support plaque and said cardholding plaque, and an operative position in which said pusher passes through said opening of said cardholding plaque and said cut in said sheet, said pusher being configured to be lodged in said opening of said support plaque, deforming an end of at least one corner of said card and inserting said end of said corner of said card through said cut in said sheet; and an actuator for actuating said cutting blades and said pusher, said actuator comprising a platform and a push lever.

16. The device according to claim 15, wherein each of said cutting blades comprising a straight cut edge prolonged by two angle-cut edges for providing said cut in said sheet in the form of a collapsible flap, wherein each of said cutting blades further comprising two longitudinal lateral slots inside each of which there is a sliding hook that is displaceable by appropriate means for fastening of said corner of said card, once said cut is provided, in order to pass said corner of said card through said cut.

17. The device according to claim 16, wherein said window of said cardholding plaque further comprising lateral holders for said card in a position which is at level with an upper surface, supplied by a superior loading box.

18. The device according to claim 15, wherein said cardholding plaque comprising guides around or proximate to said window for said cardholding plaque for coupling of a superior loading box and displacement of said loading box to face said window of said cardholding plaque and supplying of said card to be introduced, and wherein said cardholding plaque further comprising a peg extended over said window of said cardholding plaque in order to temporarily hold said card and said sheet over said support plaque.

19. The device according to claim 15 further comprising an archer for said card arranged over said cardholding plaque, said archer having two lateral buffers arranged at a mutual distance being shorter than a distance between opposed parallel laterals of said window of said cardholding plaque, wherein said actuator having pushing elements for insertion of said card.

20. A method of placing a card in a sheet, said method comprising the steps of:

a) placing a sheet on a support with at least one opening;

b) placing of a card in a card holder adjacent to said support, said card holder having an opening of substantially the same dimensions as said card;

c) activating at least one cutting device for providing at least one cut in said sheet;

d) activating a displacement device movable towards said support and said card holder, facing said opening of said support and said opening of said card holder between a non-operative position in distance from said support and said card holder, and an operative position, in which said displacement device passes through said opening of said card holder and said at least one cut in said sheet;

e) lodging said displacement device in said opening of said support;

f) deforming an end of at least one corner of said card;

g) inserting said end of said corner of said card through said at least one cut in said sheet; and h) displacing said corner of said card through said openings of said support and card holder and into said cut in said sheet.

* * * * *